US011626055B2

(12) United States Patent
Jeong et al.

(10) Patent No.: US 11,626,055 B2
(45) Date of Patent: Apr. 11, 2023

(54) DISPLAY DEVICE AND METHOD OF DRIVING THE SAME

(71) Applicant: Samsung Display Co., Ltd., Yongin-Si (KR)

(72) Inventors: Hyun-Seok Jeong, Hwaseong-si (KR); Jungkook Park, Cheonan-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/530,988

(22) Filed: Nov. 19, 2021

(65) Prior Publication Data

US 2022/0301478 A1 Sep. 22, 2022

(30) Foreign Application Priority Data

Mar. 17, 2021 (KR) ..... 10-2021-0034640

(51) Int. Cl.
*G09G 3/20* (2006.01)

(52) U.S. Cl.
CPC ... *G09G 3/2003* (2013.01); *G09G 2300/0452* (2013.01); *G09G 2310/0286* (2013.01); *G09G 2320/028* (2013.01); *G09G 2330/023* (2013.01); *G09G 2358/00* (2013.01)

(58) Field of Classification Search
CPC ..... G09G 3/2003; G09G 2300/0452; G09G 2310/0286; G09G 2320/028; G09G 2330/023; G09G 2358/00
See application file for complete search history.

(56) References Cited

U.S. PATENT DOCUMENTS 8,344,969 B2 * 1/2013 Yoon ..... H01L 27/3232 345/82
8,400,587 B2 * 3/2013 Woo ..... G09G 3/3611 349/110
2006/0109224 A1 * 5/2006 Chang ..... G09G 3/3648 345/89
2007/0109481 A1 * 5/2007 Mimura ..... G02F 1/133504 349/143
2007/0252801 A1 * 11/2007 Park ..... G09G 3/3607 345/88
2008/0143911 A1 * 6/2008 Jin ..... G02F 1/134336 349/48

(Continued)

FOREIGN PATENT DOCUMENTS

WO 2008056586 A1 5/2008

*Primary Examiner* — Kenneth Bukowski
(74) *Attorney, Agent, or Firm* — Cantor Colburn LLP

(57) ABSTRACT

A display device includes a display panel including a gate line, a data line, and a pixel electrically connected to the gate line and the data line and that displays an image based on input image data, a gate driver which outputs a gate signal to the gate line, a data driver which outputs a data voltage to the data line, and a driving controller which controls the gate driver and the data driver. The pixel includes a first pixel that emits light in a first mode and does not emit light in a second mode and a second pixel that emits light in both the first mode and the second mode, where the second pixel has a narrower viewing angle than the first pixel. The gate line includes a first gate line connected only to the first pixel and a second gate line connected only to the second pixel.

20 Claims, 9 Drawing Sheets

(56) References Cited

U.S. PATENT DOCUMENTS

| | | | | |
|---|---|---|---|---|
| 2009/0190074 | A1* | 7/2009 | Woo | G02F 1/1323 349/110 |
| 2011/0090418 | A1* | 4/2011 | Shimizu | G02F 1/1323 349/49 |
| 2017/0199403 | A1* | 7/2017 | Xu | G09G 3/3648 |
| 2020/0006694 | A1* | 1/2020 | Lim | H01L 27/326 |
| 2021/0193033 | A1* | 6/2021 | Tan | G09G 3/2003 |

* cited by examiner

FIG. 4A

| | | DL1 | DL2 | DL3 | DL4 | DL5 | DL6 | DL7 | DL8 |
|---|---|---|---|---|---|---|---|---|---|
| GL1 | ALWAYS ON | ON | ON | ON | ON | ON | ON | ON | ON |
| GL2 | ALWAYS OFF | OFF | OFF | OFF | OFF | OFF | OFF | OFF | OFF |
| GL3 | ALWAYS ON | ON | ON | ON | ON | ON | ON | ON | ON |
| GL4 | ALWAYS OFF | OFF | OFF | OFF | OFF | OFF | OFF | OFF | OFF |
| ⋮ | ⋮ | ⋮ | ⋮ | ⋮ | ⋮ | ⋮ | ⋮ | ⋮ | ⋮ |
| GLN-1 | ALWAYS ON | ON | ON | ON | ON | ON | ON | ON | ON |
| GLN | ALWAYS OFF | OFF | OFF | OFF | OFF | OFF | OFF | OFF | OFF |

FIG. 4B

| | DL1 | DL2 | DL3 | DL4 | DL5 | DL6 | DL7 | DL8 |
|---|---|---|---|---|---|---|---|---|
| | RED/BLUE | GREEN | RED/BLUE | GREEN | RED/BLUE | GREEN | RED/BLUE | GREEN |
| GL1 | OFF | GREEN | BLUE | GREEN | OFF | GREEN | BLUE | GREEN |
| GL2 | OFF | GREEN | RED | GREEN | OFF | GREEN | RED | GREEN |
| GL3 | OFF | GREEN | BLUE | GREEN | OFF | GREEN | BLUE | GREEN |
| GL4 | OFF | GREEN | RED | GREEN | OFF | GREEN | RED | GREEN |
| ⋮ | ⋮ | ⋮ | ⋮ | ⋮ | ⋮ | ⋮ | ⋮ | ⋮ |
| GLN-1 | OFF | GREEN | BLUE | GREEN | OFF | GREEN | BLUE | GREEN |
| GLN | OFF | GREEN | RED | GREEN | OFF | GREEN | RED | GREEN |

DISPLAY DEVICE AND METHOD OF DRIVING THE SAME

This application claims priority to Korean Patent Application No. 10-2021-0034640, filed on Mar. 17, 2021, and all the benefits accruing therefrom under 35 U.S.C. § 119, the content of which in its entirety is herein incorporated by reference.

BACKGROUND

1. Field

Embodiments relate generally to a display device and a method of driving the display device. More particularly, embodiments relate to a display device that operates in a narrow viewing angle mode and a method of driving the display device.

2. Description of the Related Art

A display device may be operated in a wide viewing angle mode or a narrow viewing angle mode. When the display device is operated in the narrow viewing angle mode, some of pixels included in the display device may display a black image. In such a display device, some of the pixels may be allowed to display the black image in the narrow viewing angle mode to prevent anyone other than a user from viewing a screen in a public environment.

SUMMARY

In a display device operatable in a narrow viewing angle mode, where some of the pixels are driven to display a black image in the narrow viewing angle mode, the display device may consume power. In addition, if data of some of the pixels is converted into the black image, a data load may occur in an additional black image conversion process.

Embodiments of the disclosure provide a display device in which power consumption caused by an unnecessary gate-on signal in a narrow viewing angle mode is reduced and a data load occurring in a black image conversion process is reduced.

Embodiments of the disclosure provide a method of driving a display device to reduce power consumption caused by an unnecessary gate-on signal in a narrow viewing angle mode and to reduce a data load occurring in a black image conversion step.

According to an embodiment of the invention, a display device includes a display panel including a gate line, a data line, and a pixel electrically connected to the gate line and the data line, where the display panel displays an image based on input image data, a gate driver which outputs a gate signal to the gate line, a data driver which outputs a data voltage to the data line, and a driving controller which controls the gate driver and the data driver. In such an embodiment, the pixel includes a first pixel which emits light in a first mode and does not emit light in a second mode and a second pixel which emits light in both the first mode and the second mode, where the second pixel has a narrower viewing angle than the first pixel. In such an embodiment, the gate line includes a first gate line connected only to the first pixel and a second gate line connected only to the second pixel.

In an embodiment, the gate driver may output a gate-on signal to the first gate line in the first mode and may output a gate-off signal to the first gate line in the second mode.

In an embodiment, the gate driver may output the gate-on signal to the second gate line in both the first mode and the second mode.

In an embodiment, the first gate line may be an even-numbered gate line of the gate line, and the second gate line may be an odd-numbered gate line of the gate line.

In an embodiment, each of the first pixel and the second pixel may include a red sub-pixel, a green sub-pixel, and a blue sub-pixel. In such an embodiment, a number of red sub-pixels, green sub-pixels, and blue sub-pixels connected to the first gate line may be equal to a number of red sub-pixels, green sub-pixels, and blue sub-pixels connected to the second gate line.

In an embodiment, the data line may include a first data line connected only to the first pixel, a second data line connected to both the first pixel and the second pixel, and a third data line connected only to the second pixel.

In an embodiment, the data driver may output the data voltage to the first data line in the first mode and may output a data-off voltage to the first data line in the second mode.

In an embodiment, the data driver may output the data voltage to the second data line and the third data line in both the first mode and the second mode.

In an embodiment, the driving controller may output a first mode activation signal to the gate driver and the data driver in the first mode and may output a second mode activation signal to the gate driver and the data driver in the second mode.

In an embodiment, the first mode may be a wide viewing angle mode, and the second mode may be a narrow viewing angle mode.

In an embodiment, each of the first pixel and the second pixel may have a rhombic shape.

According to an embodiment of the invention, a method of driving a display device includes determining a display panel driving mode, outputting a gate signal to a gate line, outputting a data voltage to a data line, and controlling light emission of a pixel based on the gate signal and the data voltage. In such an embodiment, the pixel includes a first pixel, which emits light in a wide viewing angle mode and does not emit light in a narrow viewing angle mode, and a second pixel, which emits light in both the wide viewing angle mode and the narrow viewing angle mode, where the second pixel has a narrower viewing angle than the first pixel. In such an embodiment, the gate line includes a first gate line connected only to the first pixel and a second gate line connected only to the second pixel.

In an embodiment, the outputting the gate signal may include outputting a gate-on signal to the first gate line in the wide viewing angle mode and outputting a gate-off signal to the first gate line in the narrow viewing angle mode.

In an embodiment, the outputting the gate signal may include outputting the gate-on signal to the second gate line in both the wide viewing angle mode and the narrow viewing angle mode.

In an embodiment, the first gate line may be an even-numbered gate line of the gate line, and the second gate line may be an odd-numbered gate line of the gate line.

In an embodiment, each of the first pixel and the second pixel may include a red sub-pixel, a green sub-pixel, and a blue sub-pixel. In such an embodiment, a number of red sub-pixels, green sub-pixels, and blue sub-pixels connected to the first gate line may be equal to a number of red sub-pixels, green sub-pixels, and blue sub-pixels connected to the second gate line.

In an embodiment, the data line may include a first data line connected only to the first pixel, a second data line connected to both the first pixel and the second pixel, and a third data line connected only to the second pixel.

In an embodiment, the outputting the data voltage may include outputting the data voltage to the first data line in the wide viewing angle mode and outputting a data-off voltage to the first data line in the narrow viewing angle mode.

In an embodiment, the outputting the data voltage may include outputting the data voltage to the second data line and the third data line in both the wide viewing angle mode and the narrow viewing angle mode.

In an embodiment, the determining the display panel driving mode may include generating a wide viewing angle mode activation signal when the display panel driving mode is the wide viewing angle mode and generating a narrow viewing angle mode activation signal when the display panel driving mode is the narrow viewing angle mode.

In embodiments of the invention, a display device and a method of driving the display device, in a narrow viewing angle mode, may output a gate-on signal to a first gate line connected only to a first pixel and may output a gate-off signal to a second gate line connected only to a second pixel. Thus, the display device and the method of driving the display device may reduce power consumption caused by a gate-on signal in the narrow viewing angle mode and may reduce a data load occurring in a black image conversion process.

BRIEF DESCRIPTION OF THE DRAWINGS

FIG. 4A is a table showing gate signals output from the arrangement of the gate lines in FIG. 3B when a display device is operated in a narrow viewing angle mode.

FIG. 4B is a table showing data voltages output from the arrangement of the data lines in FIG. 3B when a display device is operated in a narrow viewing angle mode.

DETAILED DESCRIPTION

Figure 1:
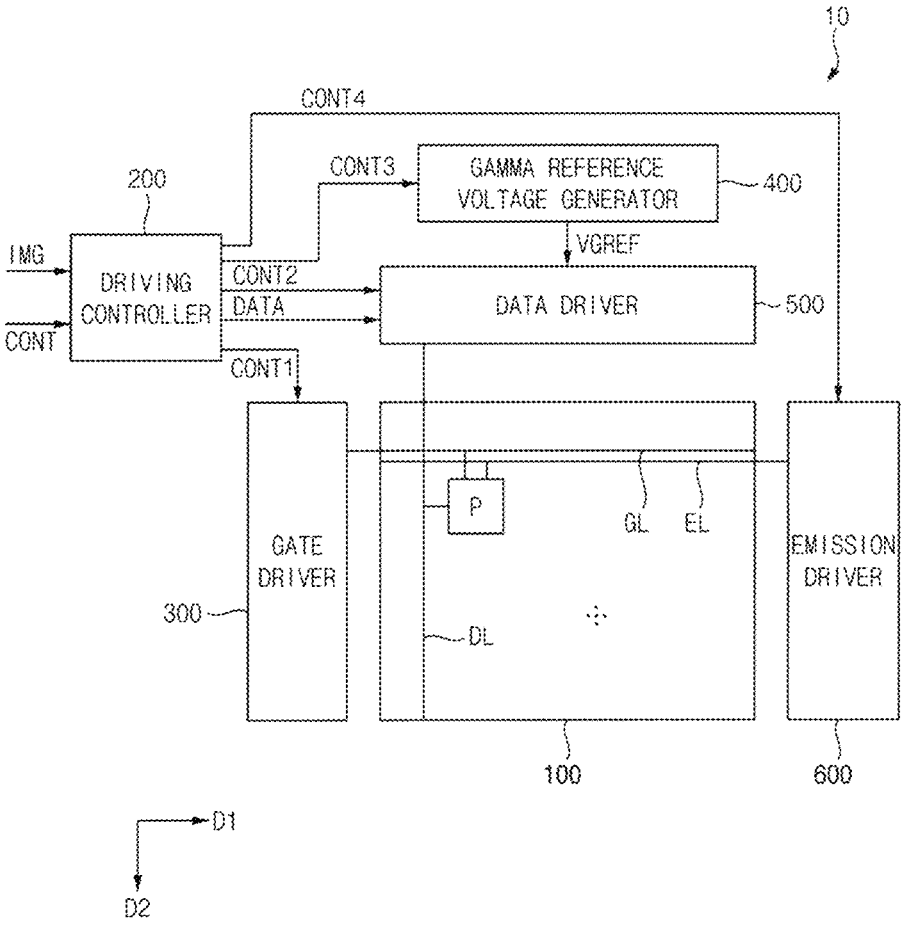
FIG. 1 is a block diagram showing a display device according to an embodiment.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, "a", "an," "the," and "at least one" do not denote a limitation of quantity, and are intended to include both the singular and plural, unless the context clearly indicates otherwise. For example, "an element" has the same meaning as "at least one element," unless the context clearly indicates otherwise. "At least one" is not to be construed as limiting "a" or "an." "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The terms "below" or "beneath" can, therefore, encompass both an orientation of above and below.

have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

Hereinafter, embodiments of the disclosure will be described in detail with reference to the accompanying drawings.

FIG. 1 is a block diagram showing a display device according to an embodiment.

Referring to FIG. 1, an embodiment of a display device 10 may include a display panel 100 and a display panel driver. The display panel driver may include a driving controller 200, a gate driver 300, a gamma reference voltage generator 400, a data driver 500, and an emission driver 600.

The display panel 100 may include a display part for displaying an image, and a peripheral part adjacent to the display part.

The display panel 100 may include a plurality of gate lines GL, a plurality of data lines DL, a plurality of emission lines EL, and a plurality of pixels P electrically connected to the gate lines GL, the data lines DL, and the emission lines EL, respectively. The gate line GL may extend in a first direction D1, the data line DL may extend in a second direction D2 intersecting the first direction D1, and the emission line EL may extend in the first direction D1.

The driving controller 200 may receive input image data IMG and an input control signal CONT from an external device (not shown). In one embodiment, for example, the input image data IMG may include red image data, green image data, and blue image data. The input image data IMG may further include white image data. In one alternative embodiment, for example, the input image data IMG may include magenta image data, yellow image data, and cyan image data. The input control signal CONT may include a master clock signal and a data enable signal. The input control signal CONT may further include a vertical synchronization signal and a horizontal synchronization signal.

The driving controller 200 may generate a first control signal CONT1, a second control signal CONT2, a third control signal CONT3, a fourth control signal CONT4, and a data signal DATA based on the input image data IMG and the input control signal CONT.

The driving controller 200 may generate the first control signal CONT1 for controlling an operation of the gate driver 300 based on the input control signal CONT to output the generated first control signal CONT1 to the gate driver 300. The first control signal CONT1 may include a vertical start signal and a gate clock signal.

The driving controller 200 may generate the second control signal CONT2 for controlling an operation of the data driver 500 based on the input control signal CONT to output the generated second control signal CONT2 to the data driver 500. The second control signal CONT2 may include a horizontal start signal and a load signal.

The driving controller 200 may generate the data signal DATA based on the input image data IMG. The driving controller 200 may output the data signal DATA to the data driver 500.

The driving controller 200 may generate the third control signal CONT3 for controlling an operation of the gamma reference voltage generator 400 based on the input control signal CONT to output the generated third control signal CONT3 to the gamma reference voltage generator 400.

The driving controller 200 may generate the fourth control signal CONT4 for controlling an operation of the emission driver 600 based on the input control signal CONT to output the generated fourth control signal CONT4 to the emission driver 600.

The gate driver 300 may generate gate signals for driving the gate lines GL in response to the first control signal CONT1 received from the driving controller 200. The gate driver 300 may output the gate signals to the gate lines GL.

The gamma reference voltage generator 400 may generate a gamma reference voltage VGREF in response to the third control signal CONT3 received from the driving controller 200. The gamma reference voltage generator 400 may provide the gamma reference voltage VGREF to the data driver 500. The gamma reference voltage VGREF may have a value corresponding to each data signal DATA.

In one alternative embodiment, for example, the gamma reference voltage generator 400 may be disposed in the driving controller 200 or the data driver 500.

The data driver 500 may receive the second control signal CONT2 and the data signal DATA from the driving controller 200, and receive the gamma reference voltage VGREF from the gamma reference voltage generator 400. The data driver 500 may convert the data signal DATA into an analog data voltage by using the gamma reference voltage VGREF. The data driver 500 may output the data voltage to the data line DL.

The emission driver 600 may generate emission signals for driving the emission lines EL in response to the fourth control signal CONT4 received from the driving controller 200. The emission driver 600 may output the emission signals to the emission lines EL.

According to an embodiment, the display device 10 may be operated in a wide viewing angle mode or a narrow viewing angle mode. When the display device 10 is operated in the narrow viewing angle mode, some of the pixels P included in the display device 10 may display a black image BLACK (shown in FIG. 2B). In such an embodiment, the display device 10 may be configured to allow some of the pixels P to display the black image in the narrow viewing angle mode to prevent anyone other than a user from viewing a screen in a public environment.

Figure 2A:
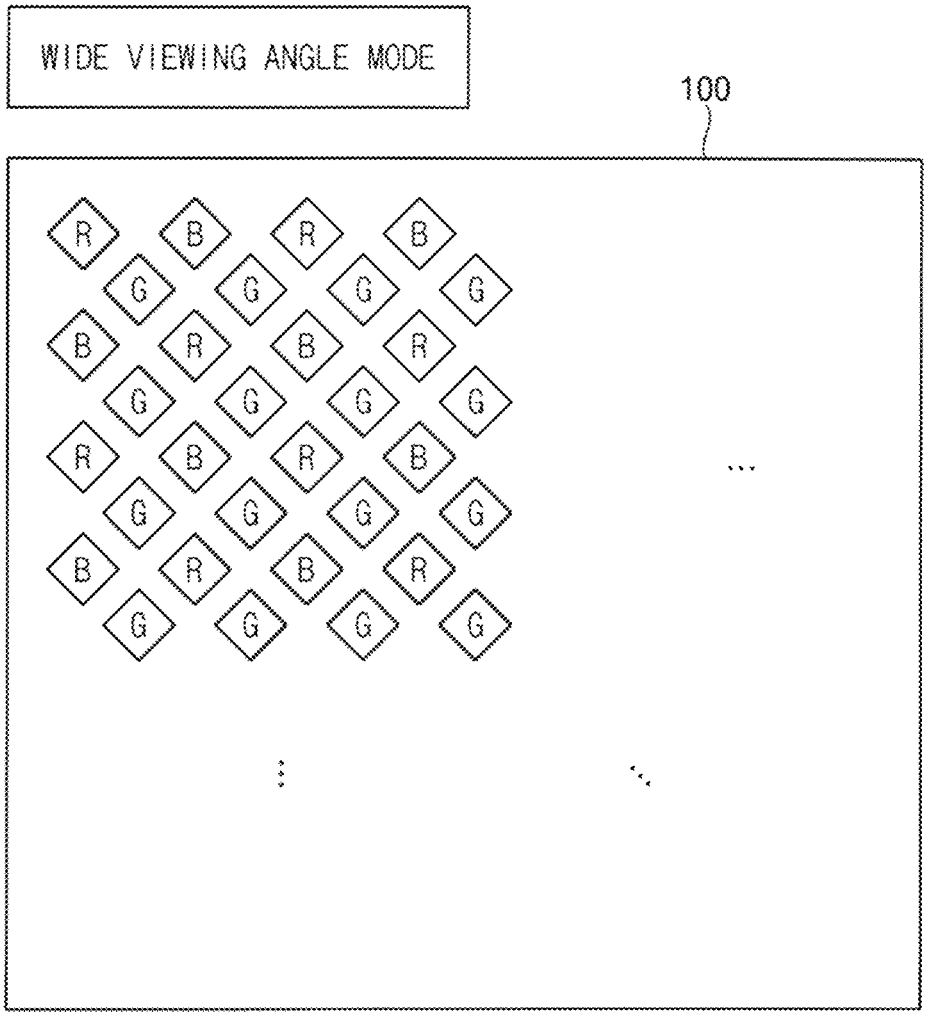
FIG. 2A is a diagram showing light emission of pixels on a display panel in a wide viewing angle mode.
Figure 2B:
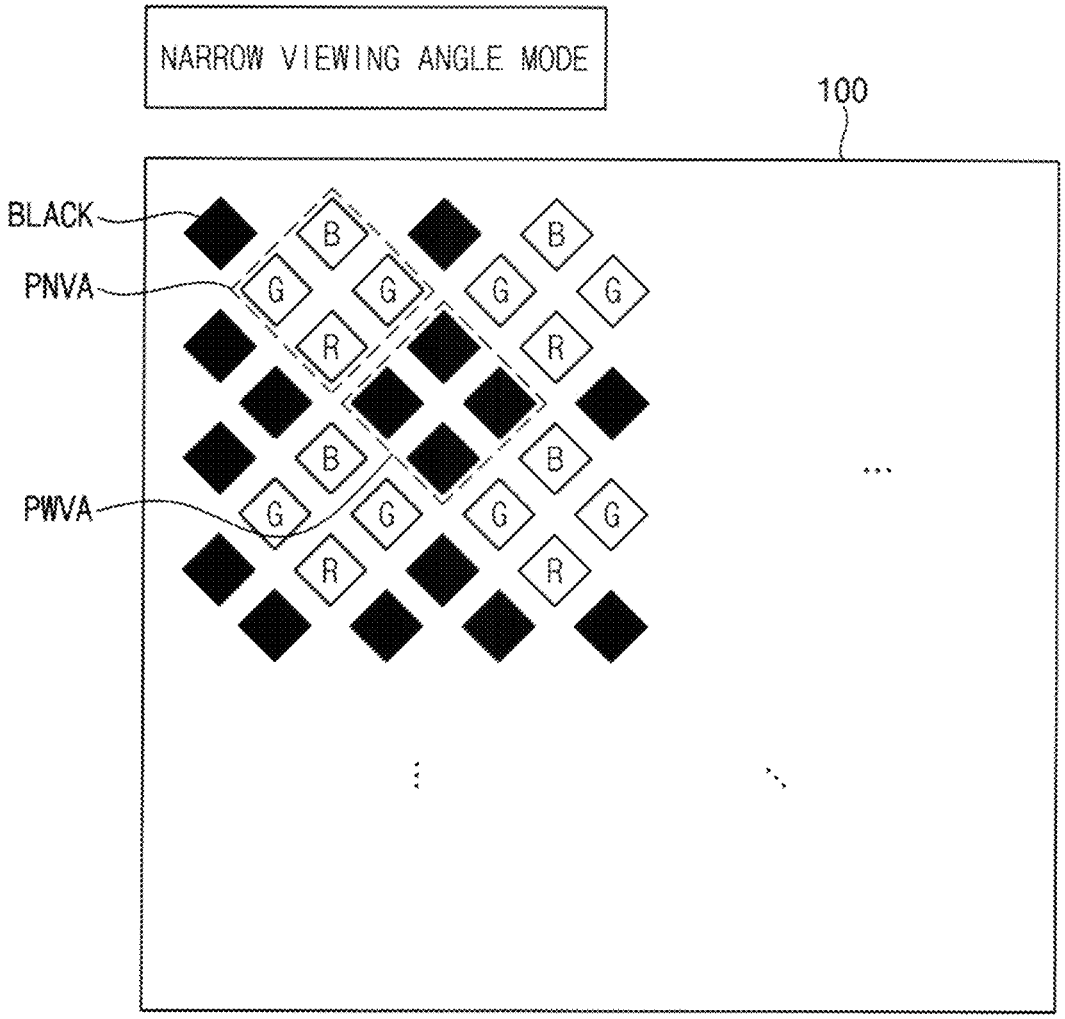
FIG. 2B is a diagram showing light emission of pixels on a display panel in a narrow viewing angle mode.

FIG. 2A is a diagram showing light emission of pixels on a display panel in a wide viewing angle mode, and FIG. 2B is a diagram showing light emission of pixels on a display panel in a narrow viewing angle mode.

Referring to FIGS. 1, 2A, and 2B, an embodiment of the display device 10 may include a display panel 100 and a display panel driver. The display panel 100 may include a plurality of pixels P electrically connected to gate lines GL and data lines DL, respectively. In an embodiment, the display device 10 may be operated in a first mode or a second mode. In such an embodiment, the first mode may be a wide viewing angle mode. In such an embodiment, the second mode may be a narrow viewing angle mode. The pixel P may include a first pixel PWVA configured to emit light in the first mode and not emit the light in the second mode. In such an embodiment, the first pixel PWVA may be a wide viewing angle pixel, for example. The pixel P may include a second pixel PNVA having a narrower viewing angle than the first pixel PWVA, and configured to emit light in both the first mode and the second mode. In such an embodiment, the second pixel PNVA may be a narrow viewing angle pixel, for example. In an embodiment, the first pixel PWVA may include a red ("R") sub-pixel, a green ("G") sub-pixel, and a blue ("B") sub-pixel. In such an embodiment, the second pixel PNVA may include an R sub-pixel, a G sub-pixel, and a B sub-pixel.

The pixels P may be repeatedly arranged (e.g., in a PenTile scheme) in the display device 10. In one embodiment, for example, when viewed in a plan view, each of the first pixel PWVA and the second pixel PNVA may have a rhombic shape. However, the disclosure is not limited thereto, and alternatively, when viewed in a plan view, each of the first pixel PWVA and the second pixel PNVA may have a triangular shape, a rectangular shape, a polygonal shape, a circular shape, a track shape, or an elliptical shape.

In an embodiment, sizes of the first pixel PWVA and the second pixel PNVA may be equal to each other as shown in FIGS. 2A and 2B, but the present disclosure is not limited thereto. In one alternative embodiment, for example, the sizes of the first pixel PWVA and the second pixel PNVA may be different from each other. In one alternative embodiment, for example, sizes of first pixels PWVA may be different from each other. In such an embodiment, sizes of second pixels PNVA may be different from each other.

When the display device 10 is operated in the first mode, both the first pixel PWVA and the second pixel PNVA may emit the light. As shown in FIG. 2A, each of the R sub-pixel, the G sub-pixel, and the B sub-pixel on the display panel 100 may emit light in the first mode.

When the display device 10 is operated in the second mode, the first pixel PWVA may not emit the light, and the second pixel PNVA may emit the light. As shown in FIG. 2B, each of the R sub-pixel, the G sub-pixel, and the B sub-pixel included in the first pixel PWVA may display the black image in the second mode. Each of the R sub-pixel, the G sub-pixel, and the B sub-pixel included in the second pixel PNVA may emit the light in the second mode. Since only the second pixel PNVA having a relatively narrow viewing angle in the display panel 100 emits the light in the second mode, anyone other than the user may be effectively prevented from viewing the screen.

In an embodiment, since some of the pixels P display the black image when the display device 10 is operated in the second mode, the display device 10 may consume power. In such an embodiment, since data of some of the pixels P has to be converted into the black image, a data load may occur in a process of converting the data into the black image.

In embodiments according to the present disclosure, the display device 10 may include a first gate line connected only to the first pixel PWVA and a second gate line connected only to the second pixel PNVA.

Figure 3A:
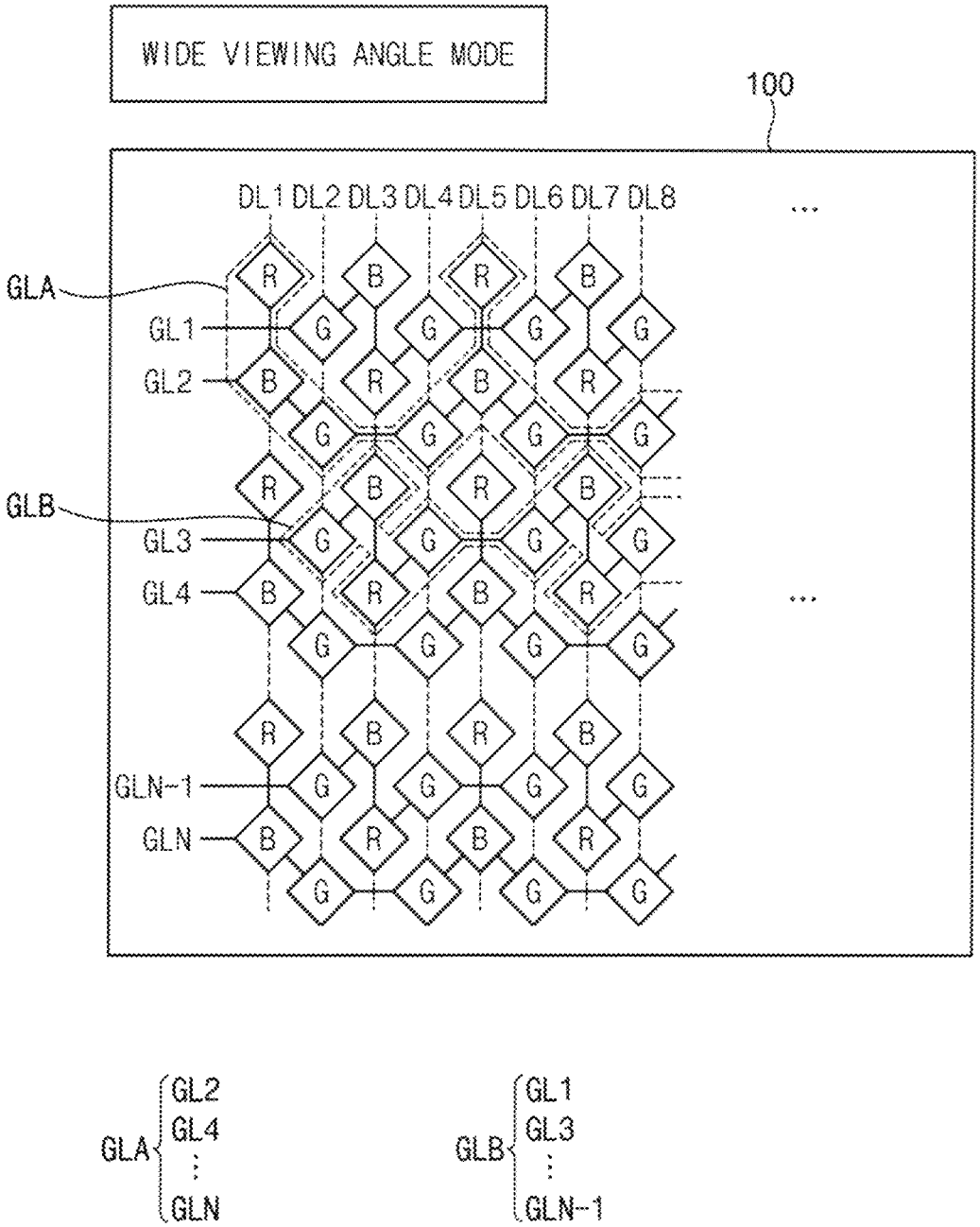
FIG. 3A is a diagram showing an arrangement of gate lines and data lines in a wide viewing angle mode according to an embodiment.
Figure 3B:
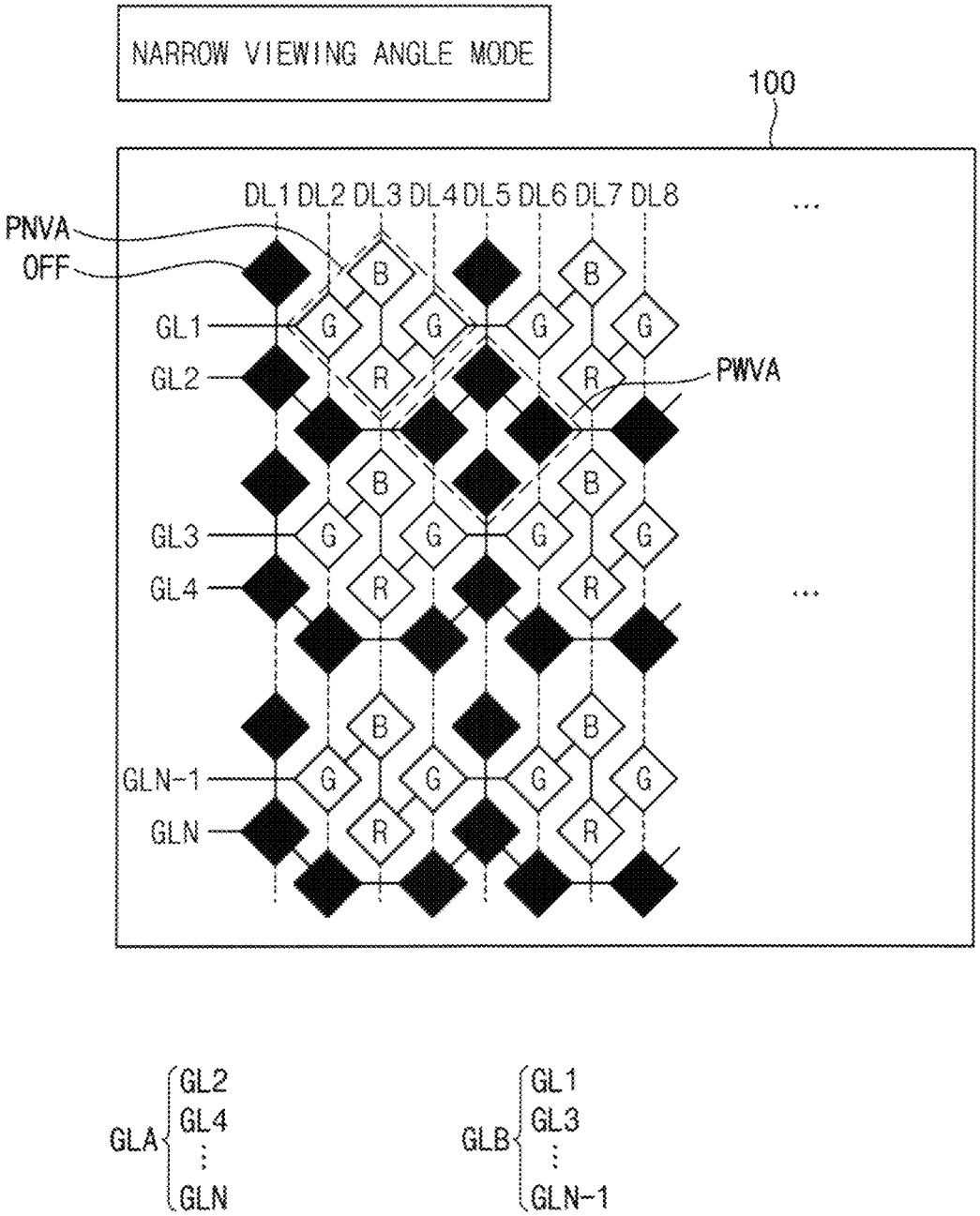
FIG. 3B is a diagram showing an arrangement of gate lines and data lines in a narrow viewing angle mode according to an embodiment.

FIG. 3A is a diagram showing an arrangement of gate lines and data lines in a wide viewing angle mode according to an embodiment, and FIG. 3B is a diagram showing an arrangement of gate lines and data lines in a narrow viewing angle mode according to an embodiment. FIG. 4A is a table showing gate signals output from the arrangement of the gate lines in FIG. 3B when a display device is operated in a narrow viewing angle mode, and FIG. 4B is a table showing data voltages output from the arrangement of the data lines in FIG. 3B when a display device is operated in a narrow viewing angle mode.

Referring to FIGS. 1, 3A, 3B, 4A, and 4B, an embodiment of the display panel 100 may include a plurality of pixels P electrically connected to gate lines GL and data lines DL, respectively. The display device 10 may include a display panel 100 and a display panel driver. The display panel driver may include a driving controller 200, a gate driver 300, and a data driver 500. The display device 10 may be operated in the first mode or the second mode, where the first mode may be the wide viewing angle mode, and the second mode may be the narrow viewing angle mode.

The driving controller 200 may generate the first control signal CONT1 for controlling the operation of the gate driver 300 based on the input control signal CONT to output the generated first control signal CONT1 to the gate driver 300. In such an embodiment, the first control signal CONT1 may include a first mode activation signal or a second mode activation signal. In one embodiment, for example, the driving controller 200 may output the first mode activation signal to the gate driver 300 in the first mode (or the wide viewing angle mode). In one embodiment, for example, the driving controller 200 may output the second mode activation signal to the gate driver 300 in the second mode (or the narrow viewing angle mode).

The driving controller 200 may generate the second control signal CONT2 for controlling the operation of the data driver 500 based on the input control signal CONT to output the generated second control signal CONT2 to the data driver 500. In an embodiment, the second control signal CONT2 may include a first mode activation signal or a second mode activation signal. In one embodiment, for example, the driving controller 200 may output the first mode activation signal to the data driver 500 in the first mode (or the wide viewing angle mode). In one embodiment, for example, the driving controller 200 may output the second mode activation signal to the data driver 500 in the second mode (or the narrow viewing angle mode).

The gate driver 300 may generate the gate signals for driving the gate lines GL in response to the first control signal CONT1 received from the driving controller 200. The gate driver 300 may output the gate signals to the gate lines GL.

In an embodiment, the gate line may include a first gate line GLA connected only to the first pixel PWVA and a second gate line GLB connected only to the second pixel PNVA. In such an embodiment, the first gate line GLA may be a wide viewing angle gate line. In such an embodiment, the second gate line GLB may be a narrow viewing angle gate line. In an embodiment, the first gate line GLA may be even-numbered gate lines among the gate lines, and the second gate line GLB may be odd-numbered gate lines among the gate lines. In one embodiment, for example, as shown in FIGS. 3A and 3B, gate lines (e.g., GL2, GL4, . . . , and GLN) corresponding to the even-numbered gate lines among the gate lines may be first gate lines GLA, and gate lines (e.g., GL1, GL3, . . . , and GLN−1) corresponding to the odd-numbered gate lines among the gate lines may be second gate lines GLB.

In an embodiment, a number of R sub-pixels, G sub-pixels, and B sub-pixels connected to the first gate line GLA may be equal to a number of R sub-pixels, G sub-pixels, and B sub-pixels connected to the second gate line GLB. In an embodiment, each of the first pixel PWVA and the second pixel PNVA may include a red (R) sub-pixel, a green (G) sub-pixel, and a blue (B) sub-pixel. In such an embodiment, the first gate line GLA may be connected to the R sub-pixel, the G sub-pixel, and the B sub-pixel included in the first pixel PWVA, and the second gate line GLB may be connected to the R sub-pixel, the G sub-pixel, and the B sub-pixel included in the second pixel PNVA.

In one embodiment, for example, as shown in FIGS. 3A and 3B, the first gate line GLA may be connected to the first pixel PWVA in a repeated pattern of the R sub-pixel, the B sub-pixel, the G sub-pixel, and the G sub-pixel (i.e., R-B-G-G). In such an embodiment, the second gate line GLB may be connected to the second pixel PNVA in a repeated pattern of the G sub-pixel, the B sub-pixel, the R sub-pixel, and the G sub-pixel (i.e., G-B-R-G). Therefore, a configuration of the R sub-pixel, the G sub-pixel, and the B sub-pixel connected to the first gate line GLA may be the same as a configuration of the R sub-pixel, the G sub-pixel, and the B sub-pixel connected to the second gate line GLB.

Accordingly, gate loads of the gate signals output to the first gate line GLA and the second gate line GLB may be equal to each other.

The gate driver 300 may output a gate-on signal to the first gate line GLA in the first mode (or the wide viewing angle mode), and output a gate-off signal to the first gate line GLA in the second mode (or the narrow viewing angle mode). The gate driver 300 may output the gate-on signal to the second gate line GLB in the first mode (or the wide viewing angle mode) and the second mode (or the narrow viewing angle mode).

In such an embodiment, the gate driver 300 may output the gate-on signal to both the first gate line GLA and the second gate line GLB in the first mode (or the wide viewing angle mode). As shown in FIG. 3A, each of the first pixel PWVA and the second pixel PNVA may receive the gate-on signal in the first mode (or the wide viewing angle mode). Since people other than the user are permitted to view the screen in the public environment in the first mode (or the wide viewing angle mode), both the first pixel PWVA and the second pixel PNVA may be controlled to emit the light.

In such an embodiment, in the second mode (or the narrow viewing angle mode), the gate driver 300 may output the gate-off signal to the first gate line GLA, and output the gate-on signal to the second gate line GLB. As shown in FIG. 3B, in the second mode (or the narrow viewing angle mode), the first pixel PWVA may receive the gate-off signal, and the second pixel PNVA may receive the gate-on signal. In such an embodiment, since the gate driver 300 outputs the gate-off signal to the first pixel PWVA in the second mode (or the narrow viewing angle mode), the gate driver 300 may display the black image in the first pixel PWVA. Therefore, in the second mode (or the narrow viewing angle mode), the first pixel PWVA having a relatively wide viewing angle may be controlled not to emit the light, and the second pixel PNVA having a relatively narrow viewing angle may be controlled to emit the light, so that no one other than the user may view the screen in the public environment.

In one embodiment, for example, as shown in FIG. 4A, the gate-off signal may be input to the first gate line GLA (e.g., GL2, GL4, . . . , and GLN) in the second mode (or the narrow viewing angle mode), and the gate-on signal may be input to the second gate line GLB (e.g., GL1, GL3, . . . , and GLN−1) in the second mode (or the narrow viewing angle mode). In such an embodiment, as described above, since an undesired gate-on signal is not input to the first pixel PWVA in the second mode (or the narrow viewing angle mode), power consumption of the display device 10 may be reduced.

The data driver 500 may receive the second control signal CONT2 and the data signal DATA from the driving controller 200, and receive the gamma reference voltage VGREF from the gamma reference voltage generator 400. The data driver 500 may convert the data signal DATA into the analog data voltage by using the gamma reference voltage VGREF. The data driver 500 may output the data voltage to the data line DL. Although eight data lines (e.g., DL1 to DL8) have been shown in FIGS. 3A and 3B for convenience of illustration and description, a number of the data lines is not limited thereto.

The data line may include: a first data line connected only to the first pixel PWVA, a second data line connected to both the first pixel PWVA and the second pixel PNVA, and a third data line connected only to the second pixel PNVA. In one embodiment, for example, as shown in FIGS. 3A and 3B, data lines (e.g., DL1 and DL5) connected only to the first pixel PWVA among the data lines may be the first data lines. In such an embodiment, data lines (e.g., DL2, DL4, DL6, and DL8) connected to both the first pixel PWVA and the second pixel PNVA among the data lines may be second data lines. In such an embodiment, data lines (e.g., DL3 and DL7) connected to the second pixel PNVA among the data lines may be third data lines.

The data driver 500 may output the data voltage to the first data line in the first mode (or the wide viewing angle mode), and output a data-off voltage to the first data line in the second mode (or the narrow viewing angle mode). The data driver 500 may output the data voltage to the second data line and the third data line in the first mode (or the wide viewing angle mode) and the second mode (or the narrow viewing angle mode).

In an embodiment, the data driver 500 may output the data voltages corresponding to the pixels P to the first data line, the second data line, and the third data line in the first mode (or the wide viewing angle mode), respectively. As shown in FIG. 3A, each of the first pixel PWVA and the second pixel PNVA may receive the data voltage in the first mode (or the wide viewing angle mode). Since people other than the user are permitted to view the screen in the public environment in the first mode (or the wide viewing angle mode), both the first pixel PWVA and the second pixel PNVA may be controlled to emit the light.

In such an embodiment, in the second mode (or the narrow viewing angle mode), the data driver 500 may output the data-off voltage to the first data line, and output the data voltage to the second data line and the third data line. As shown in FIG. 3B, in the second mode (or the narrow viewing angle mode), the first pixel PWVA may receive the data-off voltage, and the second pixel PNVA may receive the data voltage. In such an embodiment, since the data driver 500 outputs the data-off voltage to the first pixel PWVA in the second mode (or the narrow viewing angle mode), the data driver 500 may display the black image in the first pixel PWVA. Therefore, in the second mode (or the narrow viewing angle mode), the first pixel PWVA having a relatively wide viewing angle may be controlled not to emit the light, and the second pixel PNVA having a relatively narrow viewing angle may be controlled to emit the light, so that no one other than the user may view the screen in the public environment.

In one embodiment, for example, as shown in FIG. 4B, the data-off voltage may be input to the first data lines (e.g., DL1 and DL5) in the second mode (or the narrow viewing angle mode), and the data voltages corresponding to the pixels P may be input to the second data line (e.g., DL2, DL4, DL6, and DL8) and the third data line (e.g., DL3 and DL7) in the second mode (or the narrow viewing angle mode), respectively. In such an embodiment, as described above, since an undesired data voltage is not input to the first pixel PWVA in the second mode (or the narrow viewing angle mode), the power consumption of the display device 10 may be reduced. In such an embodiment, the data load occurring in the process of converting the data corresponding to the first pixel PWVA into the black image may be reduced in the second mode (or the narrow viewing angle mode).

Figure 5:
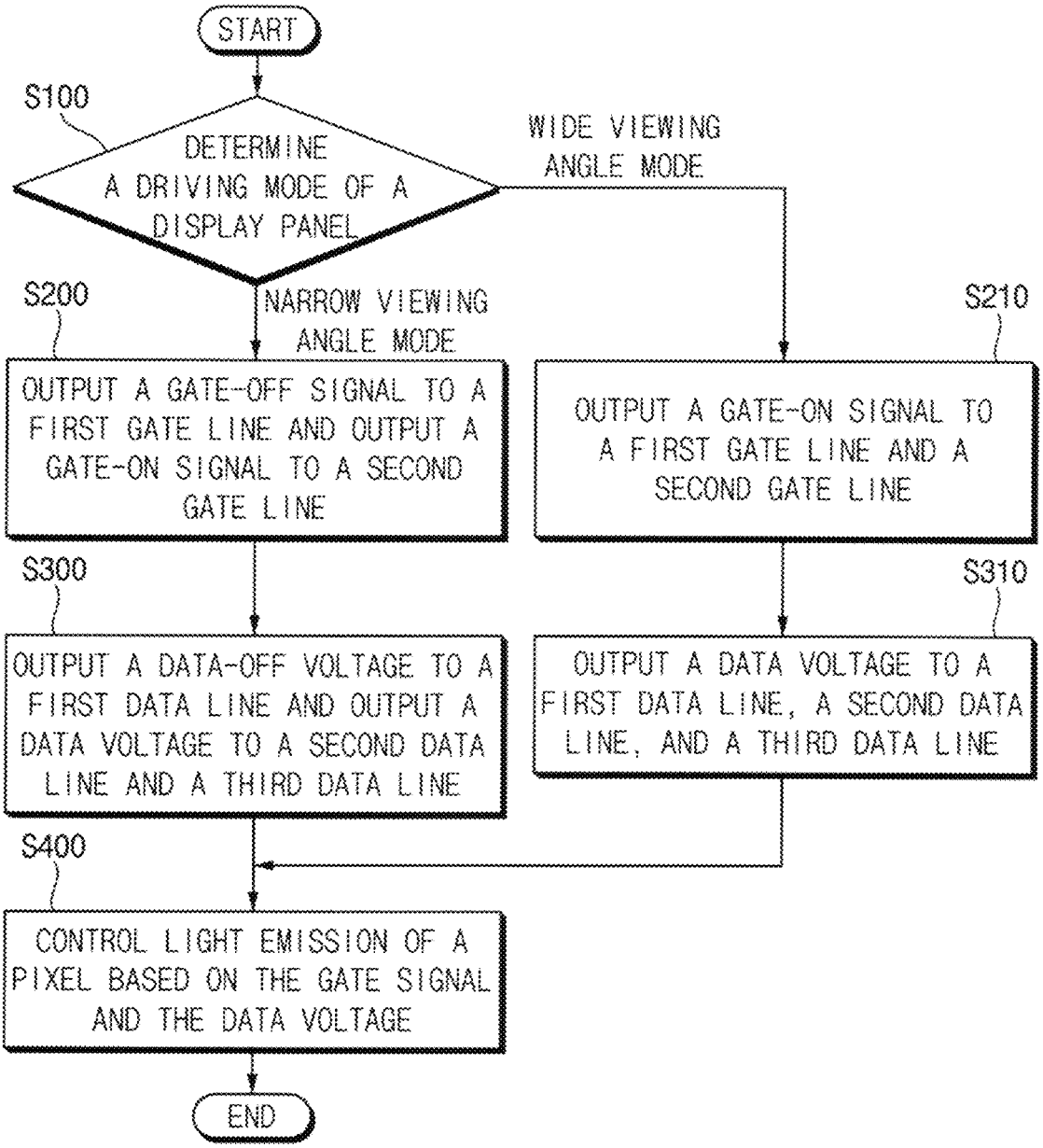
FIG. 5 is a flowchart showing an operation of the display device of FIG. 1.

FIG. 5 is a flowchart showing an operation of the display device of FIG. 1.

Referring to FIGS. 1, 3A, 3B, and 5, in an embodiment, the display device 10 may determine a driving mode of the display panel 100 (S100). The driving mode of the display panel 100 may be a first mode or a second mode, where the first mode may be a wide viewing angle mode, and the second mode may be a narrow viewing angle mode. When the display device 10 is driven in the second mode (or the narrow viewing angle mode), the display device 10 may output the gate-off signal to the first gate line GLA and output the gate-on signal to the second gate line GLB (S200), may output the data-off voltage to the first data line and output the data voltage to the second data line and the third data line (S300), and may control light emission of the pixel P based on the gate signal and the data voltage (S400). When the display device 10 is driven in the first mode (or the wide viewing angle mode), the display device 10 may output the gate-on signal to the first gate line GLA and the second gate line GLB (S210), may output the data voltage to the first data line, the second data line, and the third data line (S310), and may control light emission of the pixel P based on the gate signal and the data voltage (S400).

In an embodiment, the display device 10 may determine the driving mode of the display panel 100 (S100). In such an embodiment, the driving mode of the display panel 100 may be the first mode (or the wide viewing angle mode) or the second mode (or the narrow viewing angle mode). In one embodiment, for example, the driving controller 200 may determine whether the driving mode of the display panel 100 is the first mode (or the wide viewing angle mode) or the second mode (or the narrow viewing angle mode) based on an input signal of the user. In the first mode (or the wide viewing angle mode), the driving controller 200 may output the first mode activation signal to the gate driver 300, and output the first mode activation signal to the data driver 500. In the second mode (or the narrow viewing angle mode), the driving controller 200 may output the second mode activation signal to the gate driver 300, and output the second mode activation signal to the data driver 500.

When the display device 10 is driven in the second mode (or the narrow viewing angle mode), the display device 10 may output the gate-off-signal to the first gate line GLA, and output the gate-on signal to the second gate line GLB (S200). In such an embodiment, in the second mode (or the narrow viewing angle mode), the first pixel PWVA may receive the gate-off signal, and the second pixel PNVA may receive the gate-on signal. In such an embodiment, since the gate driver 300 outputs the gate-off signal to the first pixel PWVA in the second mode (or the narrow viewing angle mode), the gate driver 300 may display the black image in the first pixel PWVA. Therefore, in the second mode (or the narrow viewing angle mode), the first pixel PWVA having a relatively wide viewing angle may be controlled not to emit the light, and the second pixel PNVA having a relatively narrow viewing angle may be controlled to emit the light, so that no one other than the user may view the screen in the public place.

When the display device 10 is driven in the second mode (or the narrow viewing angle mode), the display device 10 may output the data-off voltage to the first data line, and output the data voltage to the second data line and the third data line (S300). In such an embodiment, in the second mode (or the narrow viewing angle mode), the first pixel PWVA may receive the data-off voltage, and the second pixel PNVA may receive the data voltage. In such an embodiment, since the data driver 500 outputs the data-off voltage to the first pixel PWVA in the second mode (or the narrow viewing angle mode), the data driver 500 may display the black image in the first pixel PWVA.

When the display device 10 is driven in the first mode (or the wide viewing angle mode), the display device 10 may output the gate-on signal to the first gate line GLA and the second gate line GLB (S210) and may output the data voltage to the first data line, the second data line, and the third data line (S310). In such an embodiment, the gate driver 300 may output the gate-on signal to both the first gate line GLA and the second gate line GLB in the first mode (or the wide viewing angle mode). In such an embodiment, each of the first pixel PWVA and the second pixel PNVA may receive the gate-on signal in the first mode (or the wide viewing angle mode). The data driver 500 may output the data voltages corresponding to the pixels P to the first data line, the second data line, and the third data line in the first mode (or the wide viewing angle mode), respectively. In such an embodiment, each of the first pixel PWVA and the second pixel PNVA may receive the data voltage in the first mode (or the wide viewing angle mode).

In an embodiment, the display device 10 may control the light emission of the pixel P based on the gate signal and the data voltage (S400). In one embodiment, for example, when the display device 10 is operated in the first mode (or the wide viewing angle mode), both the first pixel PWVA and the second pixel PNVA may emit the light. In such an embodiment, each of the R sub-pixel, the G sub-pixel, and the B sub-pixel on the display panel 100 may emit light in the first mode (or the wide viewing angle mode). Since people other than the user are permitted to view the screen in the public environment in the first mode (or the wide viewing angle mode), both the first pixel PWVA and the second pixel PNVA may be controlled to emit the light. In one embodiment, for example, when the display device 10 is operated in the second mode (or the narrow viewing angle mode), the first pixel PWVA may not emit the light, and the second pixel PNVA may emit the light. In other words, each of the R sub-pixel, the G sub-pixel, and the B sub-pixel included in the first pixel PWVA may display the black image in the second mode (or the narrow viewing angle mode). Each of the R sub-pixel, the G sub-pixel, and the B sub-pixel included in the second pixel PNVA may emit the light in the second mode (or the narrow viewing angle mode). Since only the second pixel PNVA having a relatively narrow viewing angle in the display panel 100 emits the light in the second mode (or the narrow viewing angle mode), anyone other than the user may be prevented from viewing the screen in the public environment.

As described above, according to embodiments of the display device 10, the power consumption caused by the gate-on signal in the second mode (or the narrow viewing angle mode) may be reduced, and the data load occurring in a black image conversion process may be reduced.

Figure 6:
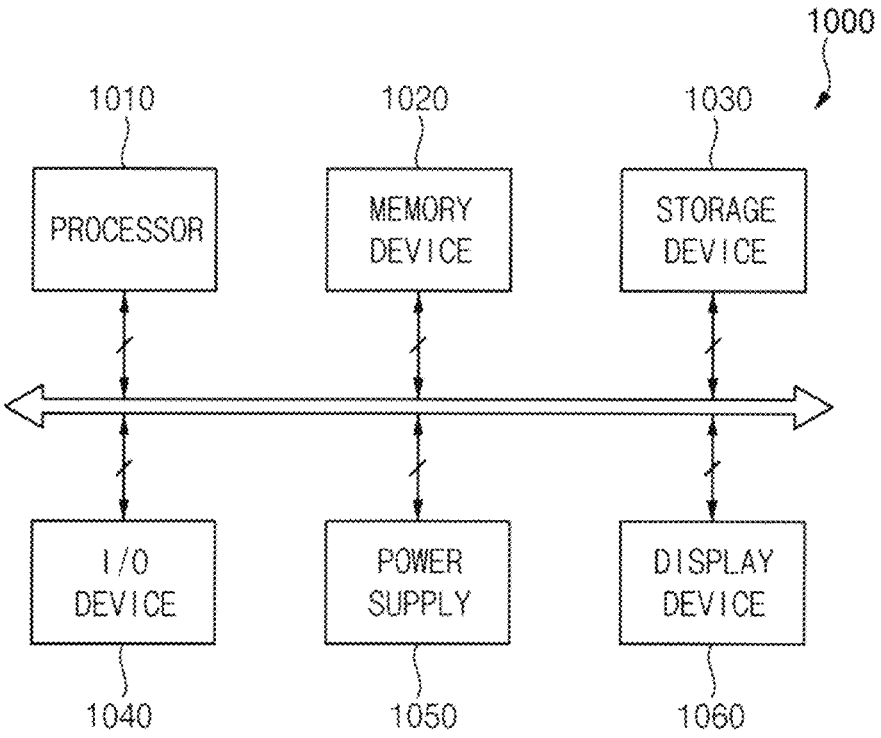
FIG. 6 is a block diagram showing an electronic device according to embodiments.
Figure 7:
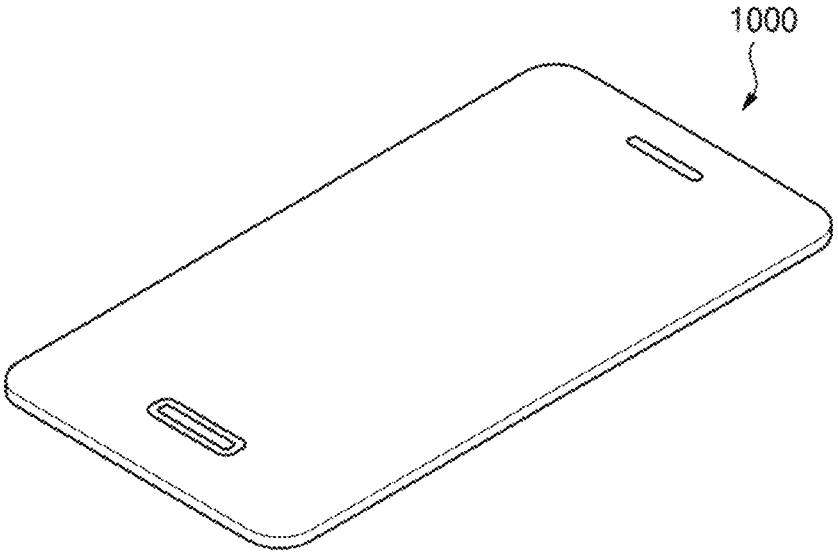
FIG. 7 is a diagram showing an embodiment in which the electronic device of FIG. 6 is implemented as a smart phone.

FIG. 6 is a block diagram showing an electronic device according to an embodiment, and FIG. 7 is a diagram showing an embodiment in which the electronic device of FIG. 6 is implemented as a smart phone.

Referring to FIGS. 6 and 7, an embodiment of the electronic device 1000 may include a processor 1010, a memory device 1020, a storage device 1030, an input/output ("I/O") device 1040, a power supply 1050, and a display device 1060. In such an embodiment, the display device 1060 may be the display device 10 of FIG. 1. In an embodiment, the electronic device 1000 may further include a plurality of ports for communicating with a video card, a sound card, a memory card, a universal serial bus ("USB") device, other electronic devices, etc. In an embodiment, as shown in FIG. 7, the electronic device 1000 may be implemented as a smart phone. However, the electronic device 1000 is not limited thereto. In one embodiment, for example, the electronic device 1000 may be implemented as a cellular phone, a video phone, a smart pad, a smart watch, a tablet personal computer ("PC"), a car navigation system, a computer monitor, a laptop, a head mounted display ("HMD") device, etc.

The processor 1010 may perform various computing functions. The processor 1010 may be a micro processor, a central processing unit ("CPU"), an application processor ("AP"), etc. The processor 1010 may be coupled to other components via an address bus, a control bus, a data bus, etc. Further, the processor 1010 may be coupled to an extended bus such as a peripheral component interconnection ("PCI") bus. The memory device 1020 may store data for operations of the electronic device 1000. In one embodiment, for example, the memory device 1020 may include at a non-volatile memory device such as an erasable programmable read-only memory ("EPROM") device, an electrically erasable programmable read-only memory ("EEPROM") device, a flash memory device, a phase change random access memory ("PRAM") device, a resistance random access memory ("RRAM") device, a nano floating gate memory ("NFGM") device, a polymer random access memory ("PoRAM") device, a magnetic random access memory ("MRAM") device, a ferroelectric random access memory ("FRAM") device, etc. and/or a volatile memory device such as a dynamic random access memory ("DRAM") device, a static random access memory ("SRAM") device, a mobile DRAM device, etc. The storage device 1030 may include a solid state drive ("SSD") device, a hard disk drive ("HDD") device, a CD-ROM device, etc. The I/O device 1040 may include an input device such as a keyboard, a keypad, a mouse device, a touch pad, a touch screen, etc., and an output device such as a printer, a speaker, etc. In an embodiment, the I/O device 1040 may include the display device 1060. The power supply 1050 may provide power for operations of the electronic device 1000. The display device 1060 may be coupled to other components via the buses or other communication links.

The display device 1060 may display an image corresponding to visual information of the electronic device 1000. In an embodiment, the display device 1060 may be operated in a first mode or a second mode, where the first mode may be a wide viewing angle mode, and the second mode may be a narrow viewing angle mode. In such an embodiment, the display device 1060 may include a gate line, a data line, and a pixel electrically connected to the gate line and the data line, and may include a display panel configured to display an image based on input image data, a gate driver configured to output a gate signal to the gate line, a data driver configured to output a data voltage to the data line, and a driving controller configured to control the gate driver and the data driver. In such an embodiment, the pixel may include a first pixel configured to emit light in the first mode and not to emit the light in the second mode and a second pixel having a narrower viewing angle than the first pixel and configured to emit light in both the first mode and the second mode. In such an embodiment, the gate line may include a first gate line connected only to the first pixel and a second gate line connected only to the second pixel.

According to embodiments of the disclosure, in the first mode, the display device 1060 may output a gate-on signal to the first gate line and may output a gate-off signal to the second gate line. Therefore, the display device 1060 may reduce power consumption caused by a gate-on signal in the narrow viewing angle mode and may reduce a data load occurring in a black image conversion step. The embodiment of the display device 1060 shown in FIG. 6 is substantially the same as those describe above, any repetitive detailed description thereof will be omitted.

Embodiments of the disclosure may be applied to a display device and an electronic device including the display device. In one embodiment, for example, the present disclosure may be applied to a digital television ("TV"), a three-dimensional ("3D") TV, a cellular phone, a smart phone, a PC, a tablet PC, a virtual reality ("VR") device, a home electronic device, a laptop, a personal digital assistants ("PDA"), a portable multimedia player ("PMP"), a digital camera, a music player, a portable game console, a car navigation system, etc.

The invention should not be construed as being limited to the embodiments set forth herein. Rather, these embodiments are provided so that this disclosure will be thorough and complete and will fully convey the concept of the invention to those skilled in the art.

While the invention has been particularly shown and described with reference to embodiments thereof, it will be understood by those of ordinary skill in the art that various changes in form and details may be made therein without departing from the spirit or scope of the invention as defined by the following claims.

What is claimed is:

1. A display device comprising:

a display panel including a gate line, a data line, and a pixel electrically connected to the gate line and the data line, wherein the display panel displays an image based on input image data;

a gate driver which outputs a gate signal to the gate line;

a data driver which outputs a data voltage to the data line; and a driving controller which controls the gate driver and the data driver, wherein the pixel includes a first pixel, which emits light in a first mode and does not emit light in a second mode, and a second pixel, which emits light in both the first mode and the second mode, wherein the second pixel has a narrower viewing angle than the first pixel, wherein each of the first pixel and the second pixel is defined by sub-pixels in different sub-pixel rows, wherein the gate line includes a first gate line connected only to the sub-pixels of the first pixel in different sub-pixel rows and a second gate line connected only to the sub-pixels of the second pixel in different sub-pixel rows, and wherein a repeated pattern of the sub-pixels of the first pixel connected only to the first gate line is different from a repeated pattern of the sub-pixels of the second pixel connected only to the second gate line.

2. The display device of claim 1, wherein the gate driver outputs a gate-on signal to the first gate line in the first mode and outputs a gate-off signal to the first gate line in the second mode.

3. The display device of claim 2, wherein the gate driver outputs the gate-on signal to the second gate line in both the first mode and the second mode.

4. The display device of claim 2, wherein the first gate line is an even-numbered gate line of the gate line, and the second gate line is an odd-numbered gate line of the gate line.

5. The display device of claim 2, wherein the sub-pixels of each of the first pixel and the second pixel includes a red sub-pixel, a green sub-pixel, and a blue sub-pixel, and wherein a number of red sub-pixels, green sub-pixels, and blue sub-pixels connected to the first gate line is equal to a number of red sub-pixels, green sub-pixels, and blue sub-pixels connected to the second gate line.

6. The display device of claim 2, wherein the data line includes a first data line connected only to the first pixel, a second data line connected to both the first pixel and the second pixel, and a third data line connected only to the second pixel.

7. The display device of claim 6, wherein the data driver outputs the data voltage to the first data line in the first mode and outputs a data-off voltage to the first data line in the second mode.

8. The display device of claim 7, wherein the data driver outputs the data voltage to the second data line and the third data line in both the first mode and the second mode.

9. The display device of claim 2, wherein the driving controller outputs a first mode activation signal to the gate driver and the data driver in the first mode and outputs a second mode activation signal to the gate driver and the data driver in the second mode.

10. The display device of claim 2, wherein the first mode is a wide viewing angle mode, and the second mode is a narrow viewing angle mode.

11. The display device of claim 2, wherein each of the first pixel and the second pixel has a rhombic shape.

12. A method of driving a display device, the method comprising:

determining a display panel driving mode;

outputting a gate signal to a gate line;

outputting a data voltage to a data line; and controlling light emission of a pixel based on the gate signal and the data voltage, wherein the pixel includes a first pixel, which emits light in a wide viewing angle mode and does not emit light in a narrow viewing angle mode, and a second pixel, which emits light in both the wide viewing angle mode and the narrow viewing angle mode, wherein the second pixel has a narrower viewing angle than the first pixel, and each of the first pixel and the second pixel is defined by sub-pixels in different sub-pixel rows, wherein the gate line includes a first gate line connected only to the sub-pixels of the first pixel in different sub-pixel rows and a second gate line connected only to the sub-pixels of the second pixel in different sub-pixel rows, and wherein a repeated pattern of the sub-pixels of the first pixel connected only to the first gate line is different from a repeated pattern of the sub-pixels of the second pixel connected only to the second gate line.

13. The method of claim 12, wherein the outputting the gate signal includes:

outputting a gate-on signal to the first gate line in the wide viewing angle mode; and outputting a gate-off signal to the first gate line in the narrow viewing angle mode.

14. The method of claim 13, wherein the outputting the gate signal includes:

outputting the gate-on signal to the second gate line in both the wide viewing angle mode and the narrow viewing angle mode.

15. The method of claim 13, wherein the first gate line is an even-numbered gate line of the gate line, and the second gate line is an odd-numbered gate line of the gate line.

16. The method of claim 13, wherein the sub-pixels of each of the first pixel and the second pixel includes a red sub-pixel, a green sub-pixel, and a blue sub-pixel, and wherein a number of red sub-pixels, green sub-pixels, and blue sub-pixels connected to the first gate line is equal to a number of red sub-pixels, green sub-pixels, and blue sub-pixels connected to the second gate line.

17. The method of claim 13, wherein the data line includes a first data line connected only to the first pixel, a second data line connected to both the first pixel and the second pixel, and a third data line connected only to the second pixel.

18. The method of claim 17, wherein the outputting the data voltage includes:

outputting the data voltage to the first data line in the wide viewing angle mode; and outputting a data-off voltage to the first data line in the narrow viewing angle mode.

19. The method of claim 18, wherein the outputting the data voltage includes:

outputting the data voltage to the second data line and the third data line in both the wide viewing angle mode and the narrow viewing angle mode.

20. The method of claim 13, wherein the determining the display panel driving mode includes:

generating a wide viewing angle mode activation signal when the display panel driving mode is the wide viewing angle mode; and generating a narrow viewing angle mode activation signal when the display panel driving mode is the narrow viewing angle mode.

* * * * *